US012006686B2

(12) United States Patent
Wong et al.

(10) Patent No.: US 12,006,686 B2
(45) Date of Patent: Jun. 11, 2024

(54) FRAMEWORK AND SYSTEM OF INTERCONNECTED FRAMEWORKS

(71) Applicant: FRAMEFLUX HOLDINGS B.V., Delft (NL)

(72) Inventors: Yu Feng Wong, Delft (NL); Thomas Roelof Hendrik Liebrand, Delft (NL)

(73) Assignee: FRAMEFLUX HOLDINGS B.V., Delft (NL)

( * ) Notice: Subject to any disclaimer, the term of this patent is extended or adjusted under 35 U.S.C. 154(b) by 570 days.

(21) Appl. No.: 17/267,563

(22) PCT Filed: Aug. 6, 2019

(86) PCT No.: PCT/NL2019/050518
§ 371 (c)(1),
(2) Date: Feb. 10, 2021

(87) PCT Pub. No.: WO2020/036485
PCT Pub. Date: Feb. 20, 2020

(65) Prior Publication Data

US 2021/0310245 A1 Oct. 7, 2021

(30) Foreign Application Priority Data

Aug. 16, 2018 (NL) ..... 2021477

(51) Int. Cl.
*E04H 12/00* (2006.01)
*E04C 3/04* (2006.01)

(52) U.S. Cl.
CPC ..... *E04C 3/04* (2013.01); *E04C 2003/0491* (2013.01); *E04C 2003/0495* (2013.01)

(58) Field of Classification Search
CPC ..... E04C 3/04; E04C 2003/0491; E04C 2003/0495; E04C 2003/0486
See application file for complete search history.

(56) References Cited

U.S. PATENT DOCUMENTS 4,539,786 A 9/1985 Nelson
4,633,624 A 1/1987 Targetti
(Continued)

FOREIGN PATENT DOCUMENTS

CN 103025401 A 4/2013
CN 106797810 A 6/2017

OTHER PUBLICATIONS

International Search Report and Written Opinion for the International Patent Application No. PCT/NL2019/050518, dated Oct. 15, 2019, 13 pages.

(Continued)

*Primary Examiner* — Amy J. Sterling
(74) *Attorney, Agent, or Firm* — KDW Firm PLLC

(57) ABSTRACT

A framework includes at least three posts, and at least three connecting ribs between the posts. First ends of the posts define a first plane, and second ends of the posts, that are opposite to the first ends thereof, define a second plane. At least one of the posts is adjustable to define, in combination with a further post of the at least three posts and two connecting ribs between the adjustable post and the further post, an adjustable trapezium that is configured to set a relative orientation between the first plane and the second plane and to thereby set an orientation of an adjoining framework. A system in which a plurality of said frameworks are interconnected.

15 Claims, 14 Drawing Sheets

(56) References Cited

U.S. PATENT DOCUMENTS

| | | | | | |
|---|---|---|---|---|---|
| 4,677,803 | A * | 7/1987 | Mikulas, Jr. | B64G 99/00 | 52/646 |
| 4,783,936 | A * | 11/1988 | Hujsak | B64G 99/00 | 52/646 |
| 6,076,770 | A * | 6/2000 | Nygren | B64G 99/00 | 52/646 |
| 6,161,359 | A * | 12/2000 | Ono | E04G 1/14 | 52/646 |
| 7,028,442 | B2 * | 4/2006 | Merrifield | E04C 3/005 | 52/645 |
| 7,533,498 | B2 * | 5/2009 | Zeigler | E04H 15/50 | 52/645 |
| 8,621,815 | B2 * | 1/2014 | Daas | E04B 1/3441 | 52/645 |
| 9,249,565 | B2 * | 2/2016 | Merrifield | E04C 3/02 | |
| 9,783,978 | B1 | 10/2017 | Alqasimi et al. | | |
| 10,738,488 | B2 * | 8/2020 | Tan | E04G 1/17 | |
| 2007/0044415 | A1 | 3/2007 | Merrifield et al. | | |

OTHER PUBLICATIONS

Second Written Opinion for the International Patent Application No. PCT/NL2019/050518, dated Jan. 28, 2020, 6 pages.

International Preliminary Report on Patentability for the International Patent Application No. PCT/NL2019/050518, dated Nov. 20, 2020, 27 pages.

* cited by examiner

FRAMEWORK AND SYSTEM OF INTERCONNECTED FRAMEWORKS

This is a national stage application filed under 35 U.S.C. § 371 of pending international application PCT/NL2019/050518, filed Aug. 6, 2019, which claims priority to Netherlands Patent Application No. 2021477, filed Aug. 16, 2018, the entirety of which applications are hereby incorporated by reference herein.

The present invention relates to a framework, in particular a framework that defines at least a portion of a supporting structure for mounting at least one stage apparatus, such as a lamp or a speaker. The invention is further related to system, wherein a plurality of said frameworks are interconnected.

Frameworks are used for a large variety of applications, and may bridge a gap to thereby provide a supporting structure. However, conventional frameworks have a fixed shape, and are not very versatile. If a framework is not long enough to bridge a gap, it is common to either select a framework of larger dimensions, or connect multiple frameworks.

U.S. Pat. No. 4,539,786 relates to deployable three dimensionally reinforced structures, and more particularly to deployable structures having a high volume compaction ratio and built upon a module of a single cell pair. Such a deployable structure may be adapted for constructing large space structures, such as space stations and space satellites having a requirement for deployable elements. In order to allow the structure to expand from a relatively small package to a relatively large structure, the structure comprises foldable longitudinal members. These foldable longitudinal members fold around a pivot that has an integrated drive and drum. The drive is configured to drive the drum to wind or unwind a tensioning cable to perform the folding or unfolding of the structure. Actuator members of an assembly of multiple structures may be interpreted as length adjustable posts that, together with connecting ribs between two parallel arranged length adjustable posts, define rectangles. As a result, a system comprising of an assembly of multiple structures may only be expanded or retracted as a whole, because a folding or unfolding of one structure is directly linked to adjacent structures it is coupled to. Thus, a folding or unfolding of one structure urges the adjacent structures to follow the same movement, allowing for a system that is easy to deploy as a whole. A disadvantage of such a system is however the lack of form freedom of multiple structures in the assembly of the system relative to each other.

United States patent application US 2007/0044415 A1 is related to deployable triangularly shaped truss beams and systems, wherein the joints allow for a uniform and synchronous retraction and extension.

U.S. Pat. No. 9,783,978 is directed to a shape-morphing space frame apparatus using linear bistable elements. Deflection of the flexible linear bistable elements provides mobility to the structure between two stable positions and in absence of mechanical joints.

An object of the present invention is to provide a framework, that is improved relative to the prior art and wherein at least one of the above stated problems is obviated.

Said object is achieved with the framework according to the present invention, comprising:

at least three posts;

at least three connecting ribs between the posts;

wherein first ends of the posts define a first plane;

wherein second ends of the posts, that are opposite to the first ends thereof, define a second plane; and wherein at least one of the posts is variable to define, in combination with a further post of the at least three posts and two connecting ribs between the variable post and the further post, a variable trapezium that is configured to set a relative orientation between the first plane and the second plane and to thereby set an orientation of an adjoining framework.

The variability may be obtained by having a post that is swappable, i.e. exchangeable for posts having varying lengths. In a more preferred embodiment, the variable post may be length adjustable.

Because at least one of the posts is variable, the framework provides increased versatility relative to prior art frameworks. On the one hand, the variability may be enough to bridge a gap, thereby preventing the need for selecting a framework of larger dimensions, which may not be readily available, or preventing the need for connecting multiple frameworks, which may also not be readily available. On the other hand, a framework having at least one post that is variable is also capable to adapt its shape. Thus, a framework that has at least one post that is variable in length provides improved versatility.

The trapezium is defined by two posts and two connecting ribs between the posts, wherein at least one of the posts is variable. Dependent on the length of the post, the shape of the trapezium may be set to thereby set a relative orientation between the first plane and the second plane that are defined by respective ends of the posts of the framework. The ends of the posts may form or define an interface for connecting to a further framework. Consequently, setting the shape of the trapezium is configured to set an orientation of said interface, and thereby of an adjoining framework.

A trapezium is characterized as a shape having four sides, wherein pairs of parallel sides are absent. It is however remarked that the trapezium shape of the framework, in dependence of the length of the variable post, may for a specific setting temporarily evolve into a trapezoid (having one pair of parallel sides) or even into a parallelogram (having two pairs of parallel sides). It is however the variable trapezium shape that allows a framework to set the orientation of a connected or to be connected adjoining framework. Consequently, a framework according to the invention is suitable to be combined in an assembly wherein adjoining frameworks have differing orientations, thereby resulting in three dimensional form freedom of said assembly. This form freedom e.g. allows stage builders to use the frameworks according to the invention as an integral component of the stage itself.

According to a preferred embodiment, the variable post is length adjustable to define, in combination with the further post of the at least three posts and two connecting ribs between the length adjustable post and the further post, the variable trapezium to be an adjustable trapezium that is configured to adjust the relative orientation between the first plane and the second plane and to thereby set the orientation of an adjoining framework. A framework having a post that is length adjustable allows the length of the respective post to be varied without the need for exchanging the respective post for a post having a different length. Stage builders may use a standard framework as "building block" for their stage, as every framework may essentially be the same, although the length of the length adjustable post may be adjusted to fit the specific needs. Moreover, frameworks having a length adjustable post are re-useable for stages of a large variety of different shapes.

Preferred embodiments are the subject of the dependent claims.

The various aspects and features described and shown in the specification can be applied, individually, wherever possible. These individual aspects, and in particular the aspects and features described in the attached dependent claims, can be made subject of divisional patent applications.

In the following description preferred embodiments of the present invention are further elucidated with reference to the drawing, in which.

Figure 21:
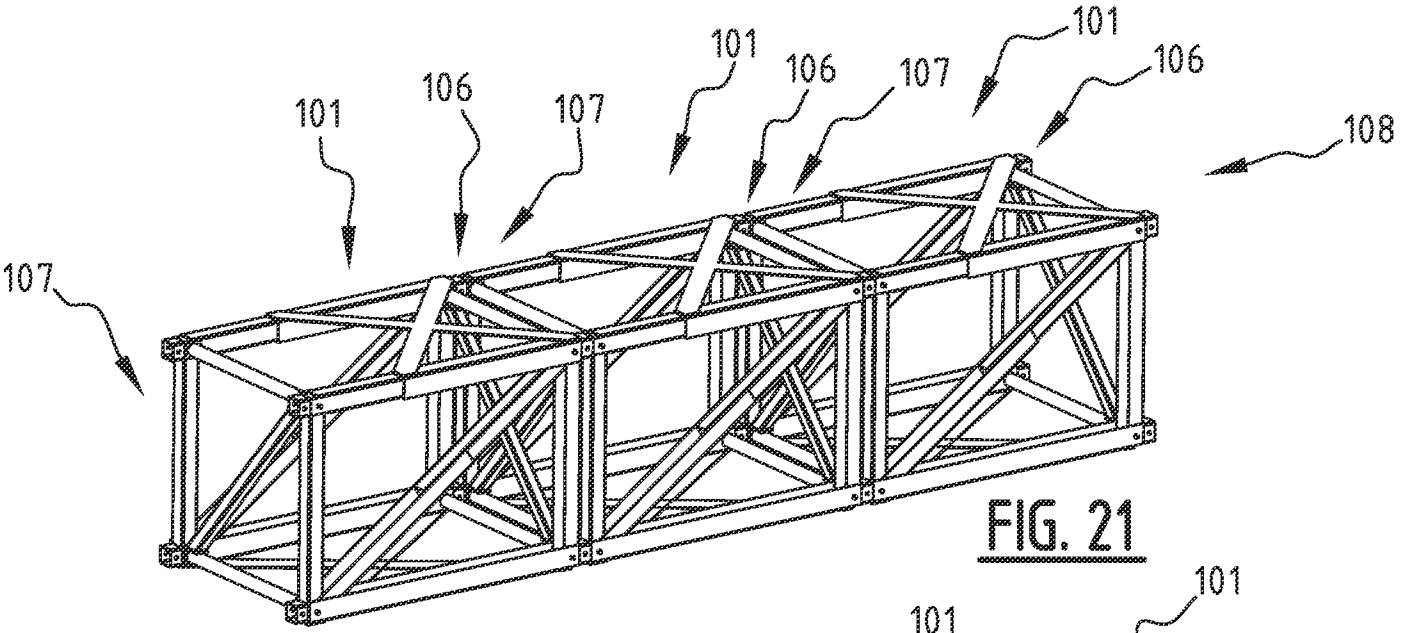
FIG. 21 is a perspective view of a system wherein three frameworks according to FIG. 12 are interconnected.
Figure 22:
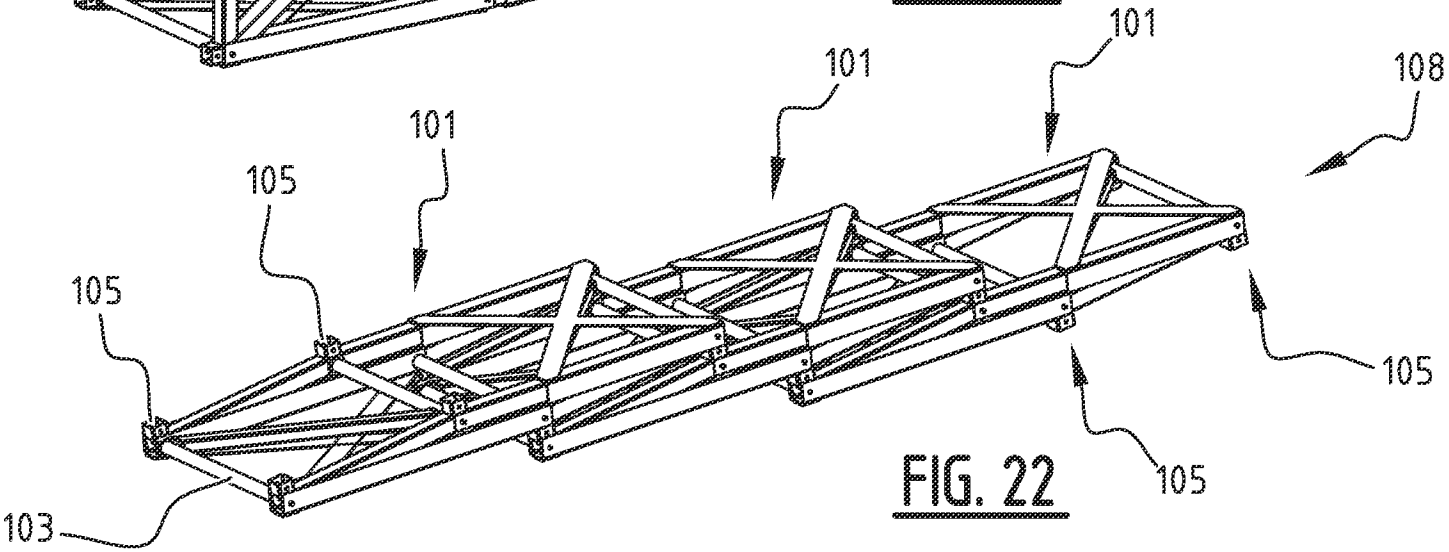
Figure 23:
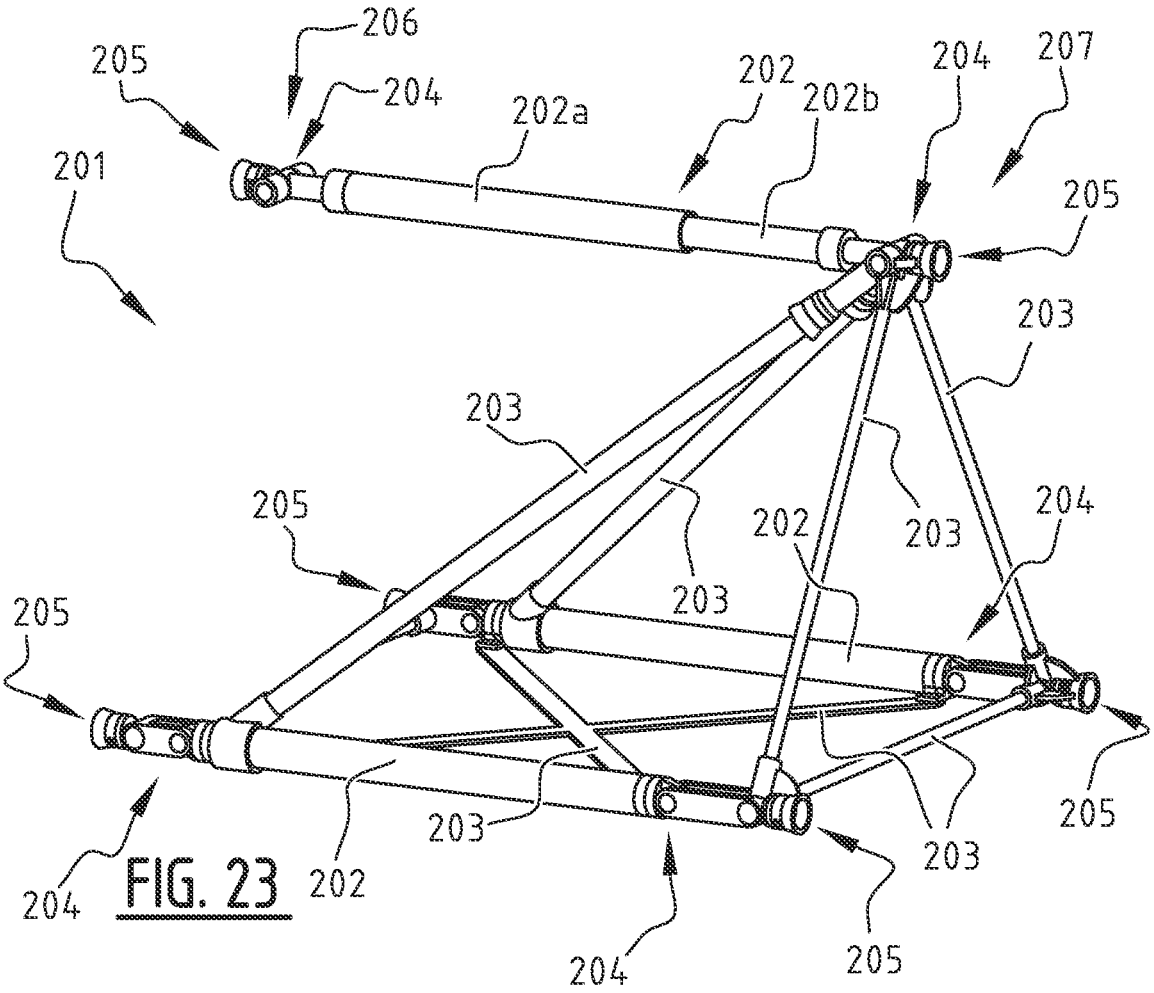
Figure 24:
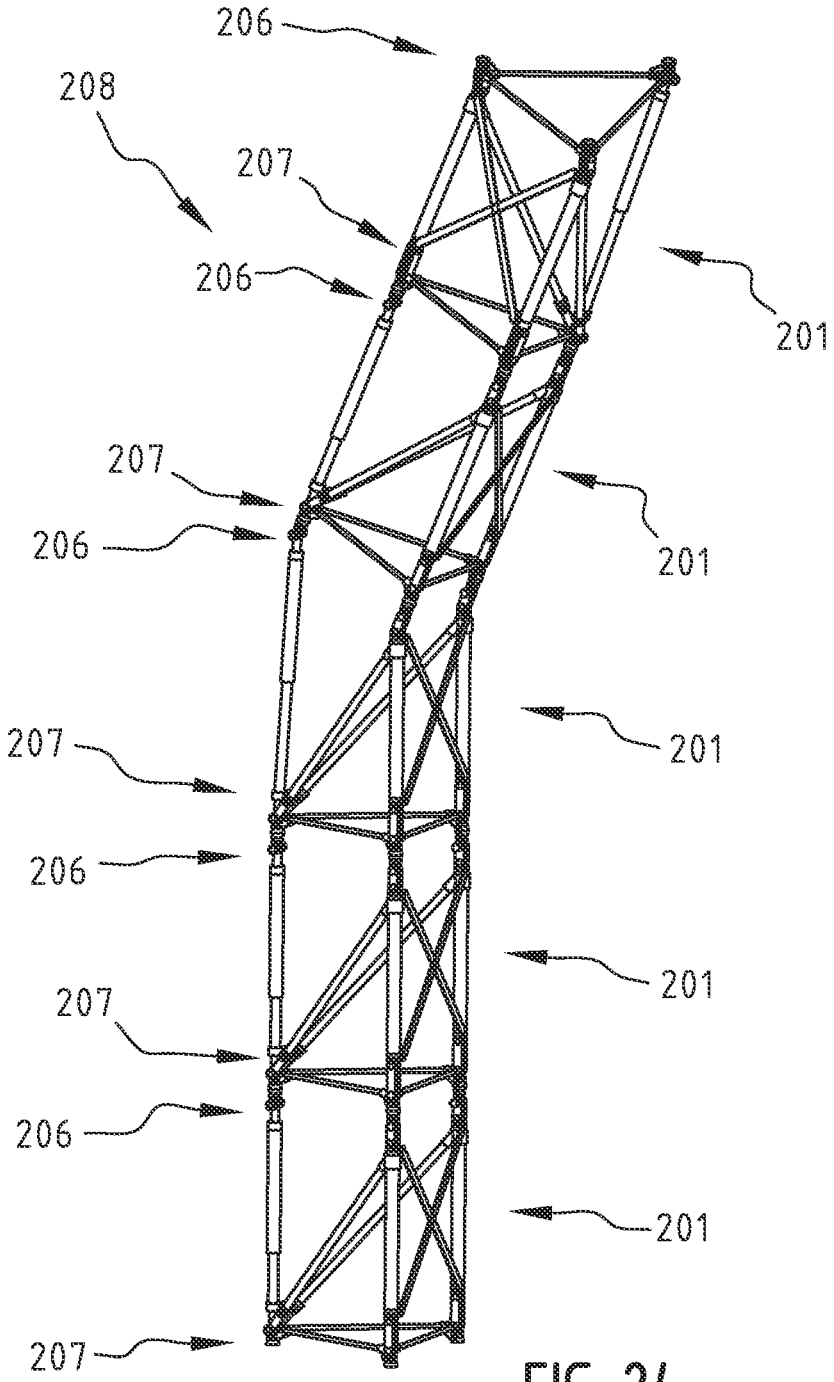
Figure 25:
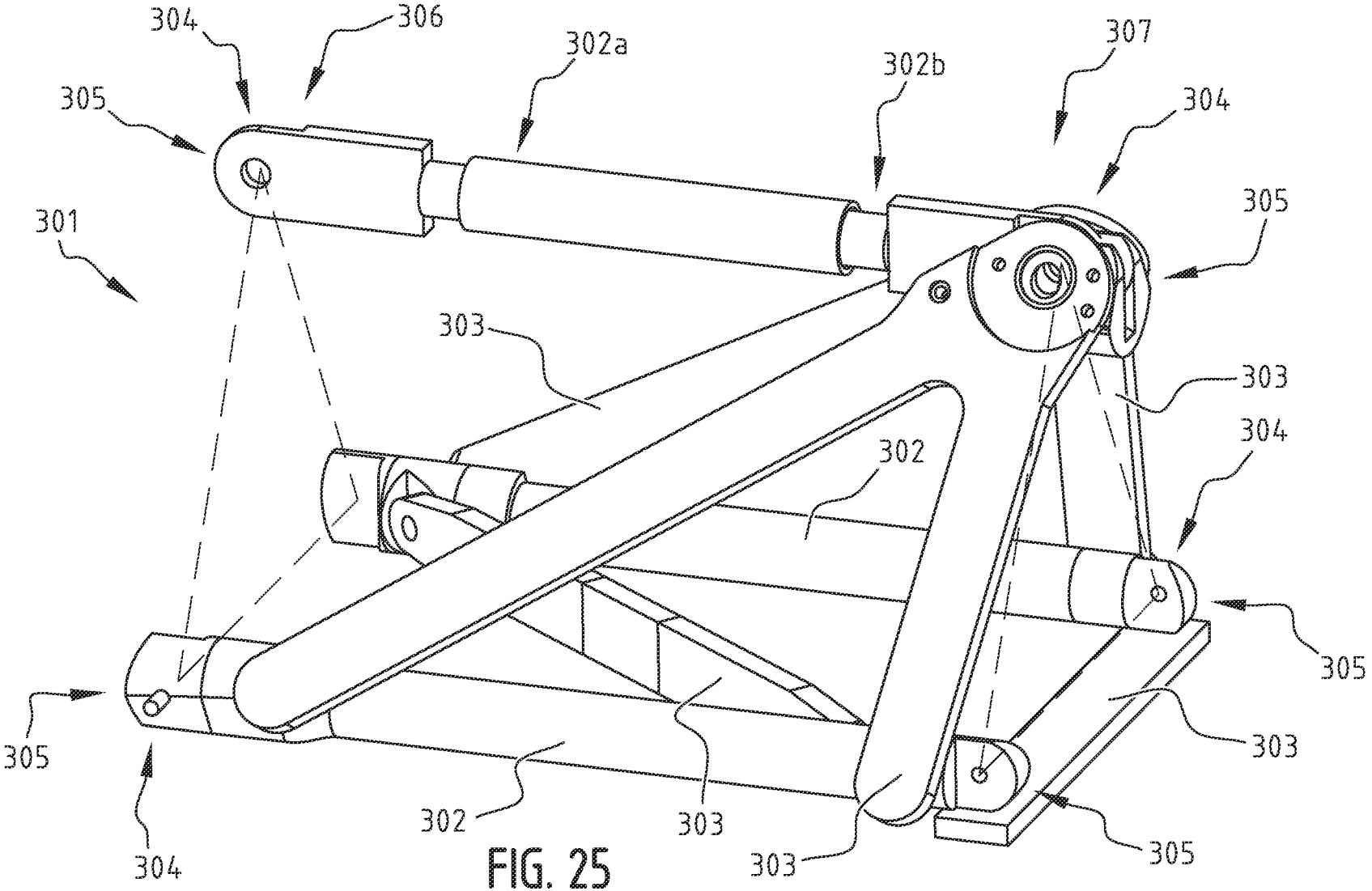

FIG. 22 is a perspective view of the system of FIG. 21 in a collapsed state thereof; and FIG. 23 is a perspective view of a framework according to a third embodiment, which is a further improvement of the first embodiment; and FIG. 24 is a perspective view of a system wherein six frameworks according to FIG. 23 are interconnected; and FIG. 25 is a perspective view of a framework according to a fourth embodiment.

The framework 1, 101, 201, 301 according to the invention comprises at least two post 2, 102, at least two connecting ribs 3, 103 between the posts 2, 102, and wherein at least one of the posts 2, 102 is length adjustable.

Such a framework 1, 101, 201, 301 is shown in four embodiments. A first embodiment having a triangular cross section is shown in FIGS. 1-11. A second embodiment having a rectangular, and more specifically a substantially square cross section, is the subject of FIGS. 12-22. The skilled person will understand that the framework may also be flat. Although not specifically shown, a flat framework may also be recognized as one of the sides of the first or second embodiment. A third embodiment that is shown in FIGS. 23 and 24 is a further development, and in particular a simplification, of the first embodiment. The fourth embodiment of FIG. 25 is an alternative to the third embodiment.

Framework 1, 101, 201, 301 comprises at least one hinge 4, 104, 204, 304 between at least one connecting rib 3, 103, 203, 403 and at least one post 2, 102, 202, 302. Having a hinge 4, 104, 204, 304 allows the connecting rib 3, 103, 203, 303 to be connected at any location to the at least one post 2, 102, 202, 302 that is length adjustable, i.e. the adjustable length may be arranged between two connecting ribs 3, 103, 203, 303 that are connected to said length adjustable post 2, 102, 202, 302.

In the shown embodiments, at least one connecting rib 3, 103, 203, 303 comprises two hinges 4, 104, 204, 304 wherein each hinge 4, 104, 204, 304 is configured to connect said connecting rib 3, 103, 203, 303 to a respective post 2, 102, 202, 302.

At least one post 2, 102, 202, 302 comprises two hinges 4, 104, 204, 304 wherein each hinge 4, 104, 204, 304 is configured to connect said post 2, 102, 202, 302 to a respective connecting rib 3, 103, 203, 303.

If the posts 2, 102, 202, 302 extend substantially parallel relative to each other, multiple frameworks 1, 101, 202, 302 may be easily connected. It is noted here that fixed posts 2, 102, 202, 302 may be exactly parallel relative to each other, but that the length adjustable post may only be exactly parallel at a specific length thereof, e.g. when the length thereof is identical to the length of the other posts 2, 102, 202, 302. However, when the length of the length adjustable post 2, 102, 202, 302 is adjusted, it will slightly rotate and result in an orientation that is not parallel anymore to the other posts 2, 102, 202, 302 and thus defines a trapezium shape. The framework 1, 101, 201, 301 may comprise one or more than one connector 5, 105, 205, 305 that is configured to connect said framework 1, 101, 201, 301 to an adjoining framework 1, 101, 201, 301. Preferably, a plurality of connectors 5, 105, 205, 305 are arranged uniformly distributed on a circle, which may be an imaginary circle. This allows adjoining frameworks 1, 101, 201, 301 to be coupled in a variety of relative orientations, as will be explained below for a triangular framework 1, 201 defining an equilateral triangle in cross section, and a rectangular framework 101 defining a square cross section. The connector 5, 105, 305, 405 may be arranged or arrangeable at or near an end of a post 2, 102, 202, 302.

Figure 2:
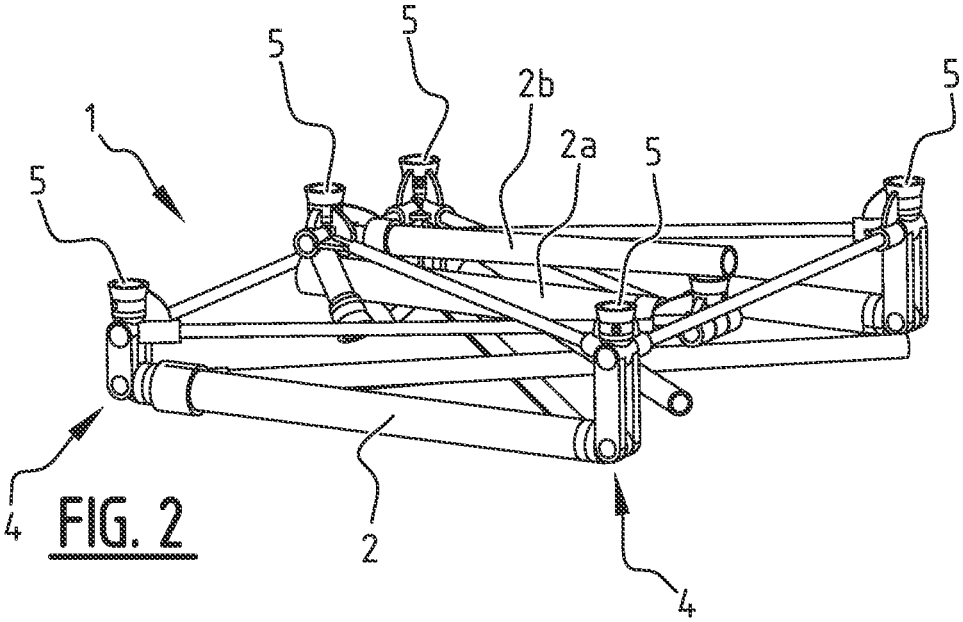
FIG. 2 is a perspective view of the framework of FIG. 1 in a collapsed state thereof.
Figure 13:
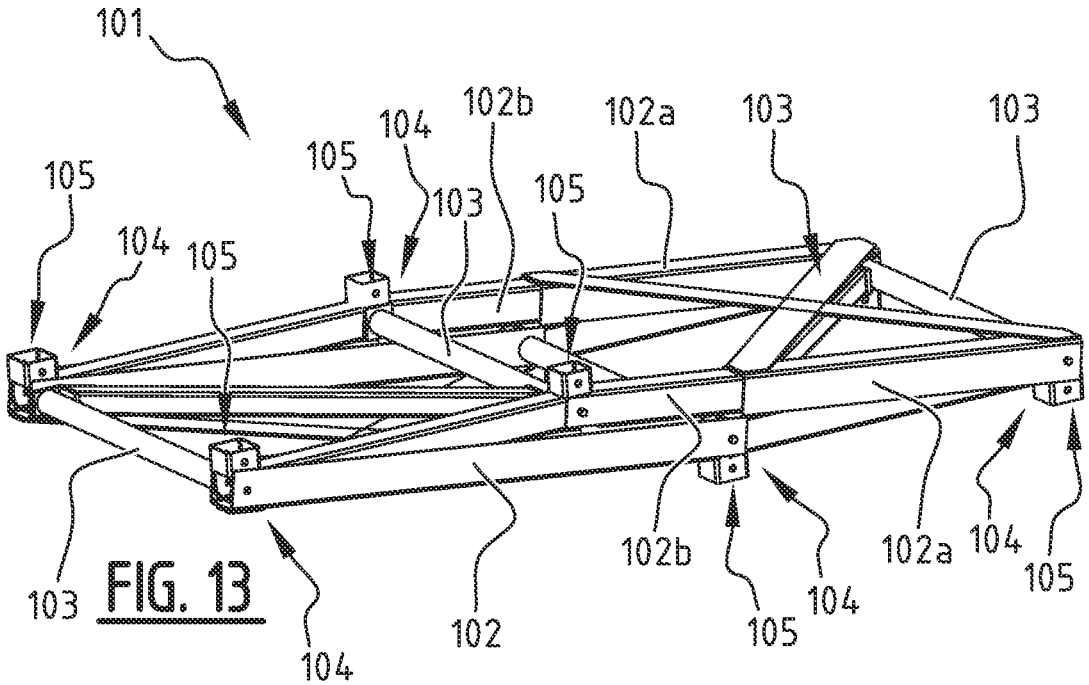
FIG. 13 is a perspective view of the framework of FIG. 12 in a collapsed state thereof.
Figure 14:
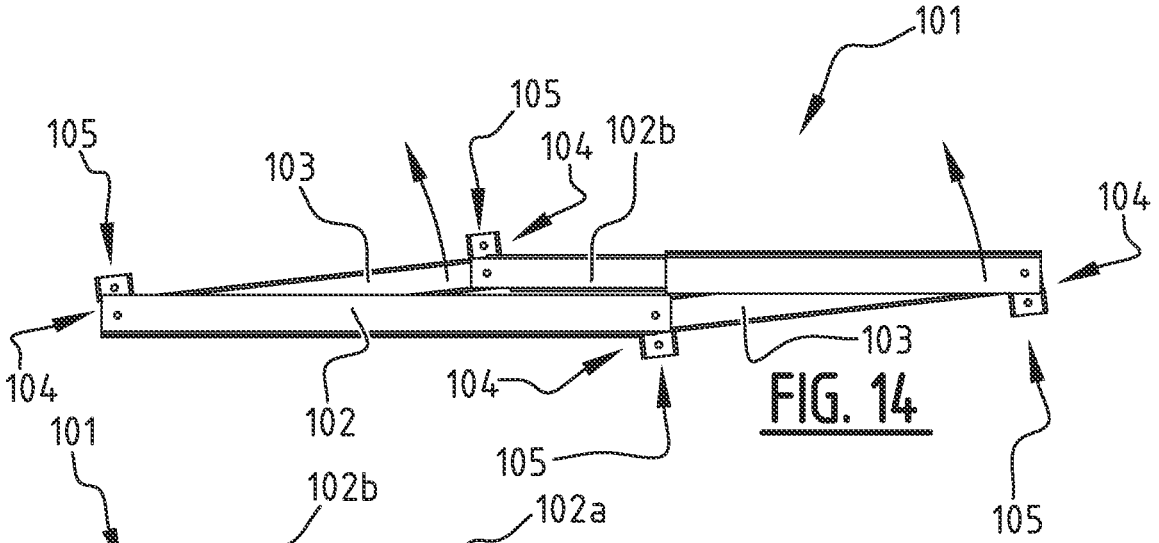
FIGS. 14-16 are side views showing successive steps of transforming the framework from the collapsed that of FIG. 13 to the extended state of FIG. 12.

The framework 1, 101, 201, 301 may be collapsible into a collapsed state (FIGS. 2 and 13).

At least one post 2, 102, 202, 302 which is preferably the post 2, 102, 202, 302 that is length adjustable, comprises two parts 2*a*, 2*b*; 102*a*, 102*b*; 202*a*, 202*b*; 302*a*, 302*b* that are moveable relative to each other, and for the first and second embodiment preferably engageable and disengageable relative to each other.

The shown frameworks 1, 101, 201, 301 comprise at least three posts 2, 102, 202, 302 thereby providing a robust framework 1, 101, 201, 301. Now, first the framework 1 according to the first embodiment as shown in FIGS. 1-11 is discussed in more detail, followed by a description of the framework 101 according to the second embodiment.

Figure 3:
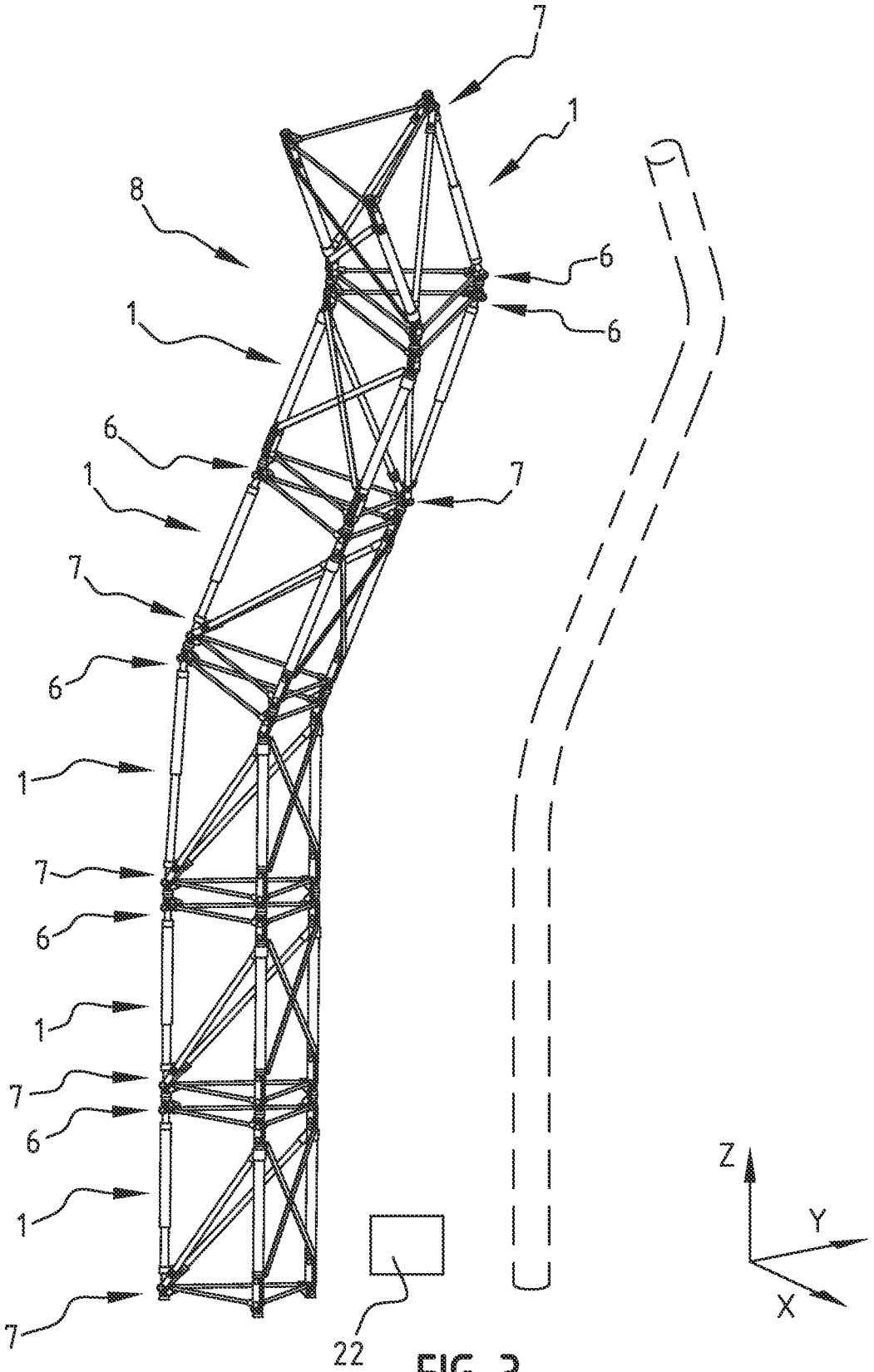
FIG. 3 is a perspective view of a system wherein six frameworks according to FIG. 1 are interconnected.
Figure 4:
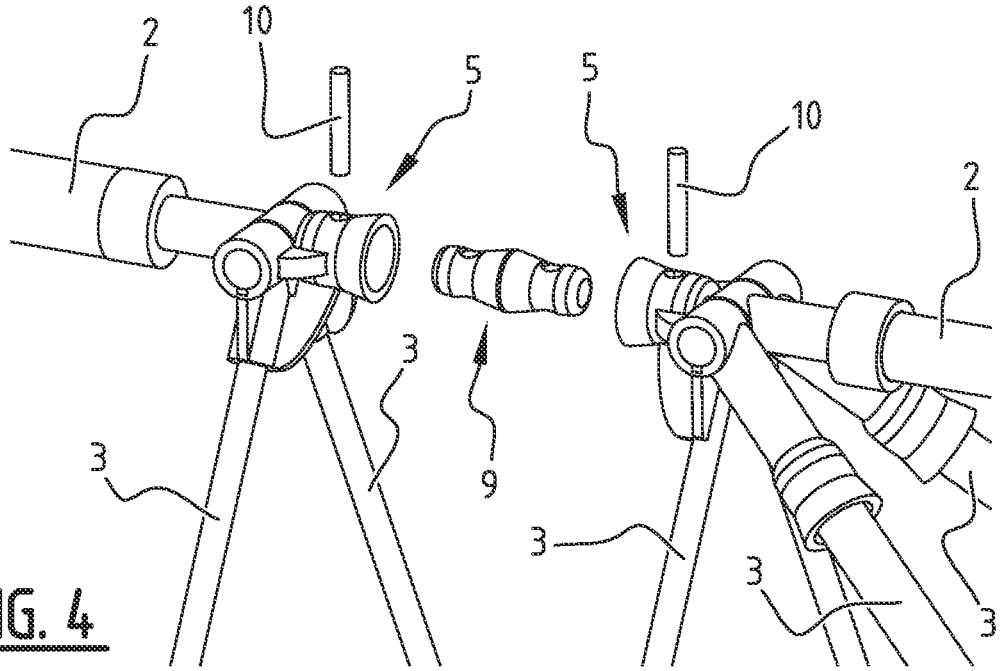
FIG. 4 is a perspective view of a connector connecting two frameworks according to FIG. 1.

In FIGS. 1-11, framework 1 comprises three posts 2 that define a triangular cross section. In the specific embodiment shown, a total of ten connecting ribs 3 are arranged between the posts 2. The flat connecting ribs 3 only serve as reinforcement, and may not be applied at all. On the other hand, if additional strength and rigidity is required, even further connecting ribs 3 may be added. At both opposite ends 6, 7 of the framework 1, three connecting ribs 3 are arranged between three connectors 5 to form a rigid triangle (FIG. 9), allowing multiple frameworks 1 to be easily connected (FIG. 4) to form a system 8 of interconnected frameworks 1 (FIG. 3).

Each framework 1 may be given a desired shape (FIGS. 8A-8C) by adjusting the length of the length adjustable post 2. An assembly of frameworks 1 each having a predetermined shape allows a user to build a system 8 of interconnected frameworks 1 (FIG. 3) of complex three-dimensional designs.

Please note that the opposite ends 6, 7 may be connected freely to one of the opposite ends 6, 7 of a further framework 1, thereby providing improved form freedom and design capabilities. In FIG. 3, end 6 of the uppermost framework 1 is connected to end 6 of the framework 1 below. For all the other frameworks 1 in FIG. 3, an end 6 is connected to an end 7 of an adjacent framework 1.

Any shape wherein connectors 5 are arranged uniformly distributed on a(n imaginary) circle may allow adjoining frameworks 1 to be coupled in a variety of relative orientations. For example, a triangular framework 1 defining an equilateral triangle in cross section allows connecting frameworks to be arranged in three positions relative to each other, i.e. having a relative rotation of 120° along the longitudinal axes thereof, wherein the longitudinal axes extend parallel to the posts 2. Due to the post 2 being length adjustable, the system 8 may define three-dimensional shapes.

Figure 5:
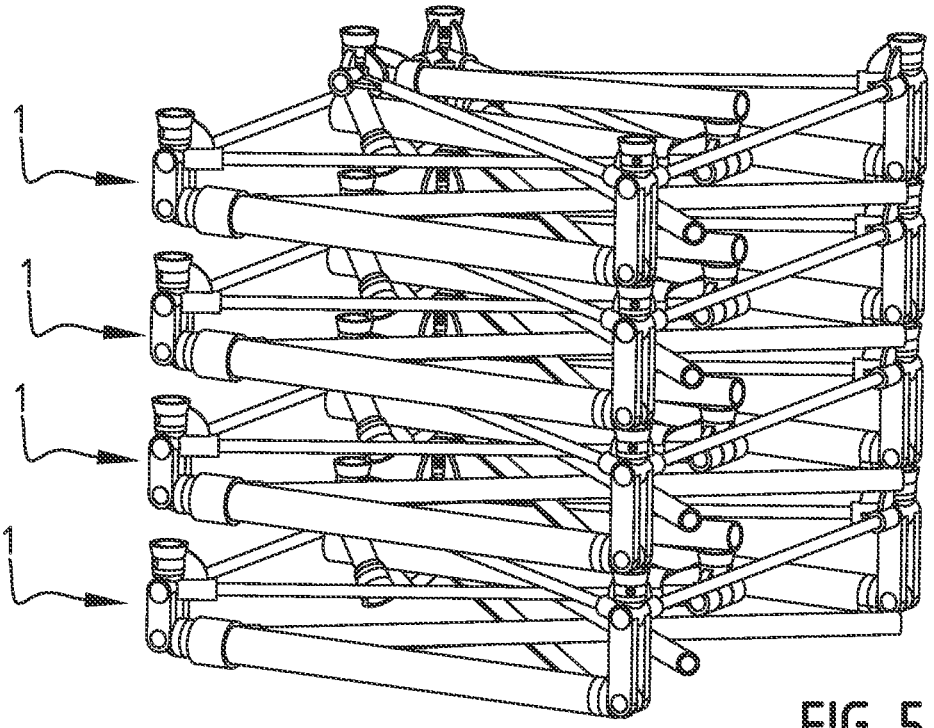
FIG. 5 is a perspective view of four frameworks of FIG. 1 in a collapsed state, stacked for transport or storage.
Figure 7:
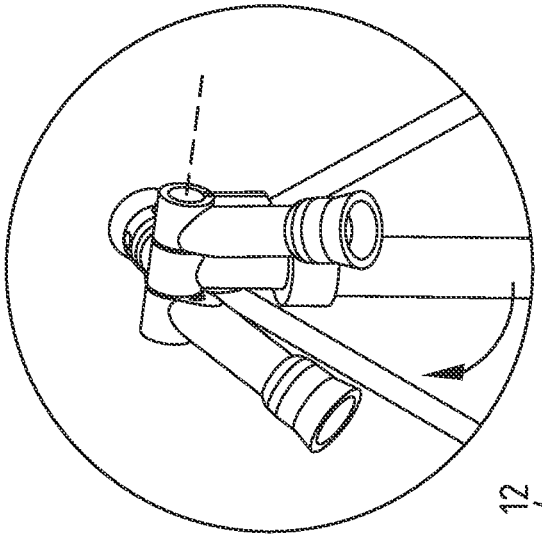
FIGS. 6 and 7 are perspective views of transforming the framework from the collapsed that of FIG. 2 to the extended state of FIG. 1.

The frameworks 1 may be connected and disconnected (FIG. 4), which allows a system 8 to be taken apart for storage and transport. The connectors 5 may be connected using a connection piece 9 and locking pins 10. FIG. 5 shows a total of four frameworks 1 in a compact stack.

Figure 1:
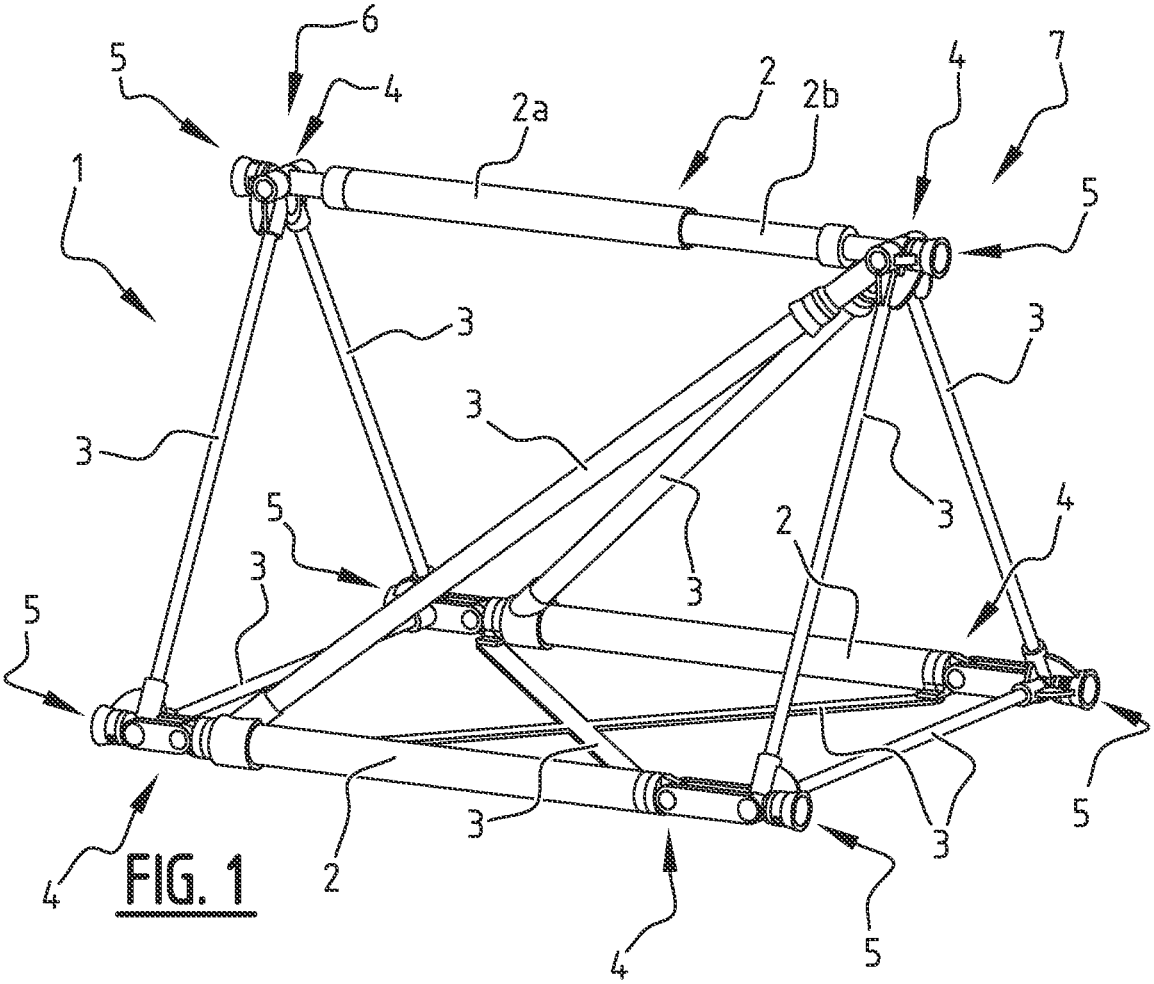
FIG. 1 is a perspective view of a framework according to a first embodiment.
Figure 6:
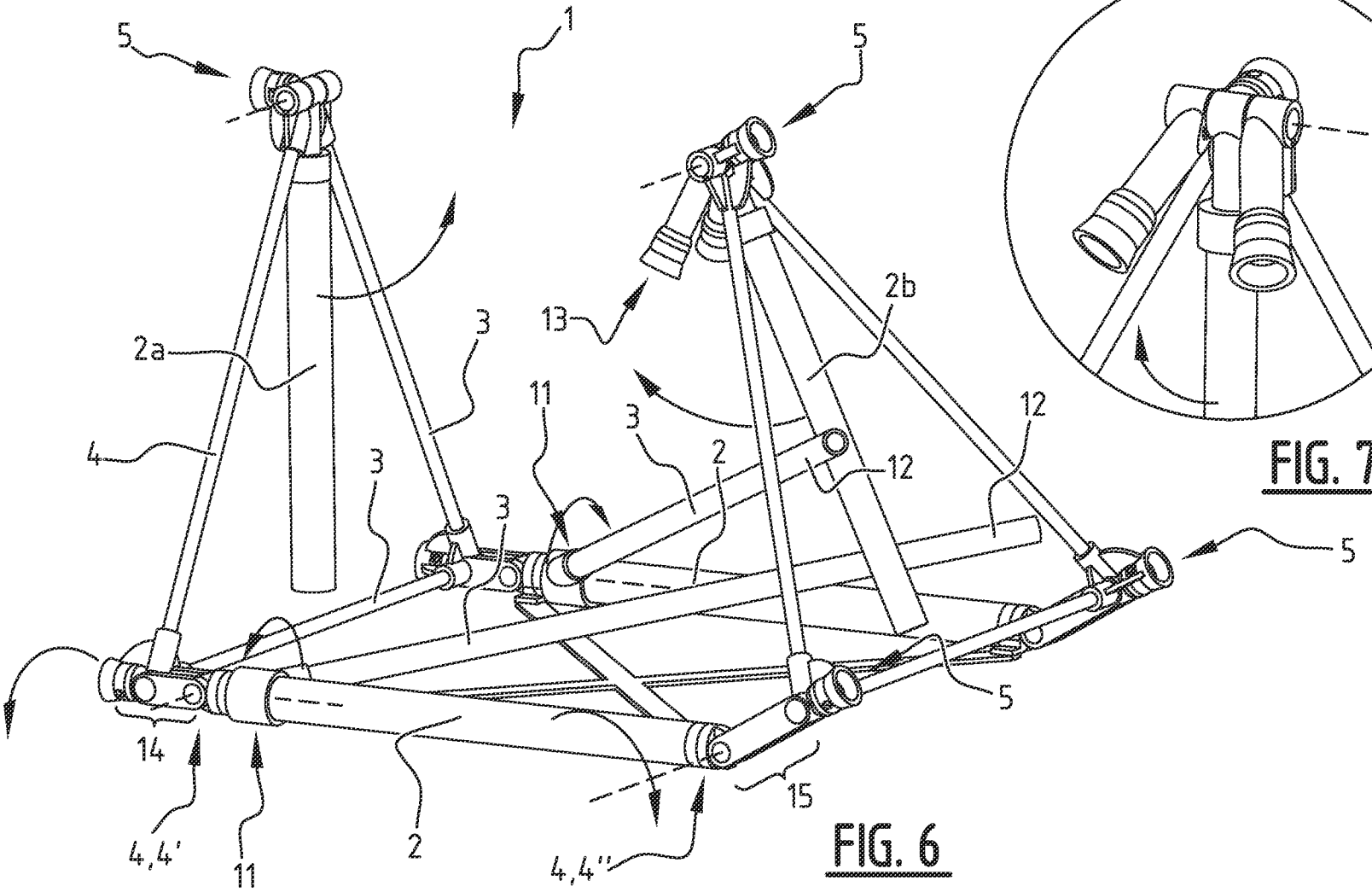
Figure 9:
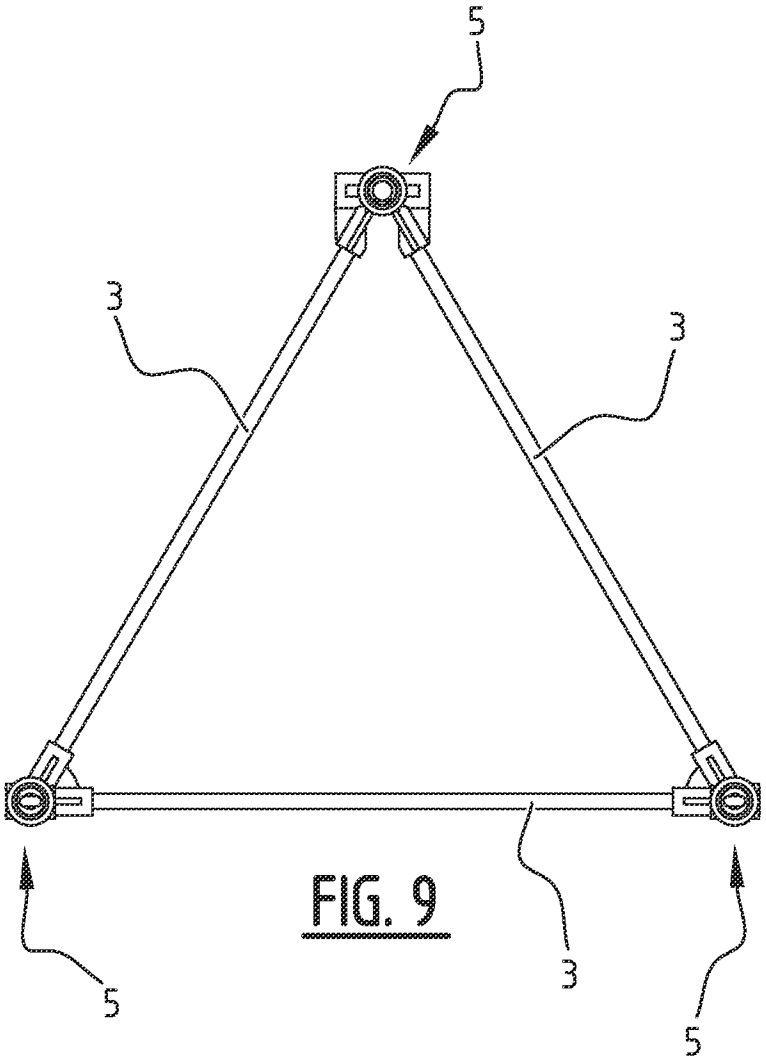
FIG. 9 is a frontal view of the side views in FIGS. 8A-8C.
Figures 8A, 8B, 8C:
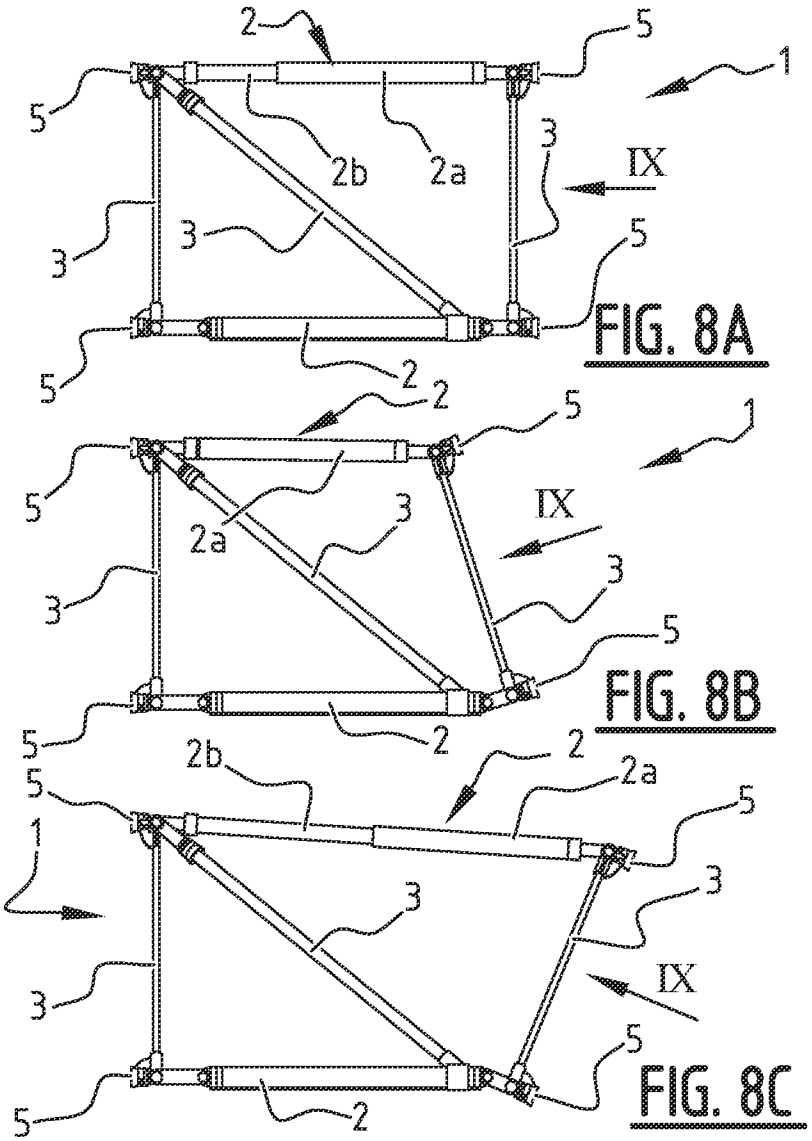
FIGS. 8A-8C are side views of the framework of FIG. 1 wherein a length adjustable post is shown in different lengths.

FIG. 6 shows an intermediate state of transforming the framework 1 from the collapsed that of FIG. 2 to the extended state of FIG. 1, wherein arrows indicate how the different parts are moved relative to each other. The post 2 that is length adjustable is shown in a disengaged state of the parts 2*a*, 2*b* thereof. The other two posts 2 have a fixed length and each comprise a connecting rib 3 that comprises a swivel connection 11. This swivel connection 11 allows these connecting ribs 3 to be arranged with their ends 12 in a respective receiving part 13 that can be best seen in FIG. 7.

At least one hinge 4' between the post 2 and the connecting rib 3 defines an offset 14, and at least one further hinge 4" between the post 2 and the connecting rib 3 defines a further offset 15 that is different from the offset 14 defined by the at least one hinge 4'. The hinge 4' that defines the offset 14 and the further hinge 4" that defines the further offset 15 are arranged at opposite ends of the post 2. Because the offset 14 and offset 15 differ in length, the framework 1 may be very compact in collapsed state (FIG. 2), as it allows the different parts of the framework 1 to compactly fold over each other.

Figure 10:
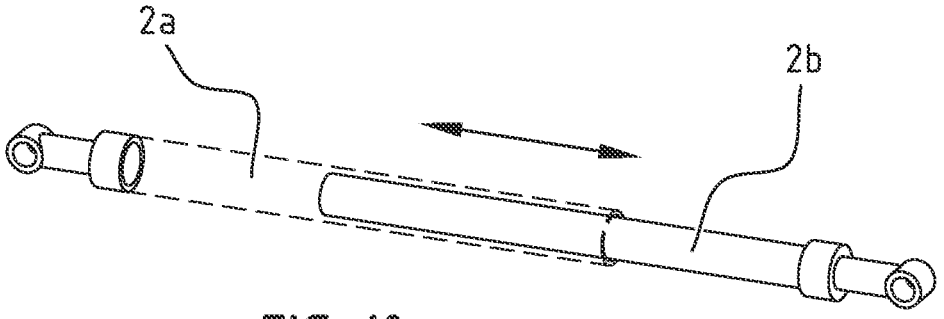
FIG. 10 is a perspective and partly transparent view of a length adjustable post.
Figure 11A:
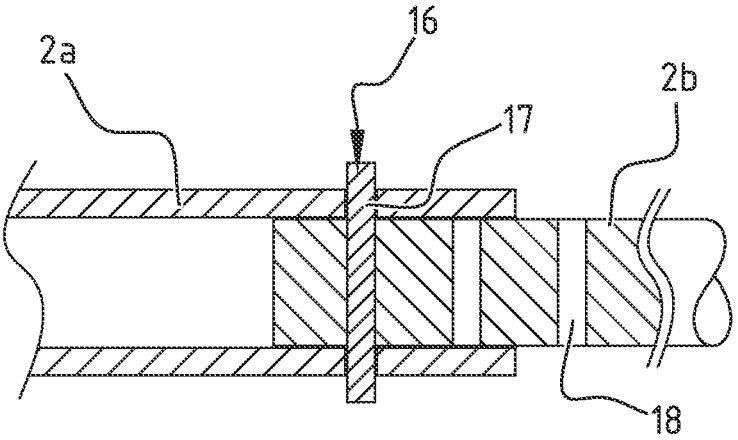
FIGS. 11A-11C are cross sectional views of alternative embodiments of the length adjustable post.
Figure 11B:
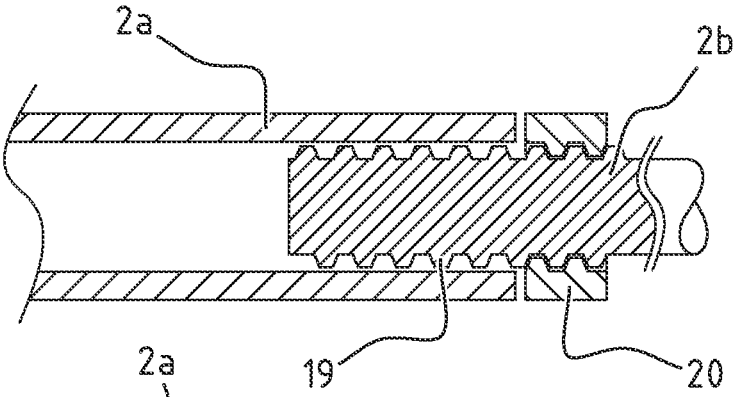
Figure 11C:
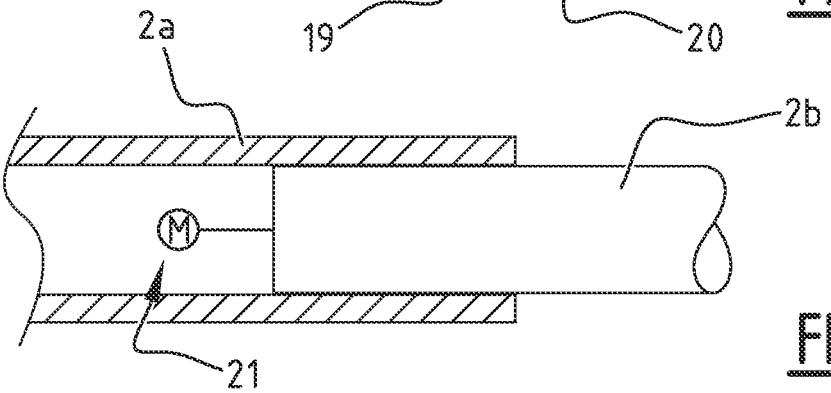
Figure 12:
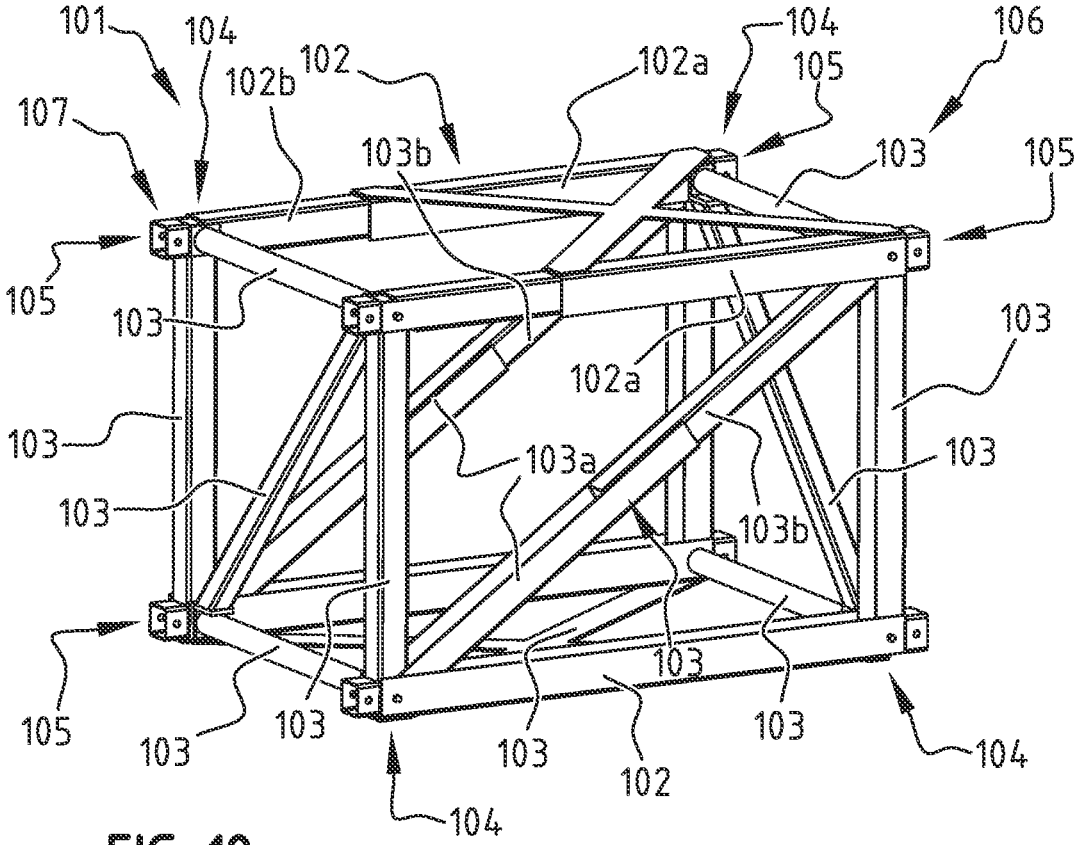
FIG. 12 is a perspective view of a framework according to a second embodiment.

FIG. 10 shows a partly transparent view of a length adjustable post 2, of which alternative embodiments are shown in the cross sectional views of FIGS. 11A-11C. In FIG. 11A, a locking pin 16 may be arranged through respective through holes 17, 18 in the parts 2*a*, 2*b* of post 2. FIG. 11B shows an embodiment with a screw spindle 19 and a drive ring 20, whereas FIG. 11C shows a sliding arrangement having a drive 21, such as a linear motor, e.g. an electric motor or a hydraulic motor. Of course, the skilled person may combine any of the embodiments shown in FIGS. 11A-11C, e.g. combining a locking pin (FIG. 11A) with a screw spindle 19 (FIG. 11B), or with an embodiment having a drive (FIG. 11C). An alternative to a screw spindle could be a turnbuckle.

In FIGS. 12-22, framework 101 comprises four posts 102 that define a square cross section. At least two posts 102 are and at least one connecting rib 103 may be length adjustable. In the shown embodiment, two posts 102 and two connecting ribs 103 are length adjustable.

Figure 15:
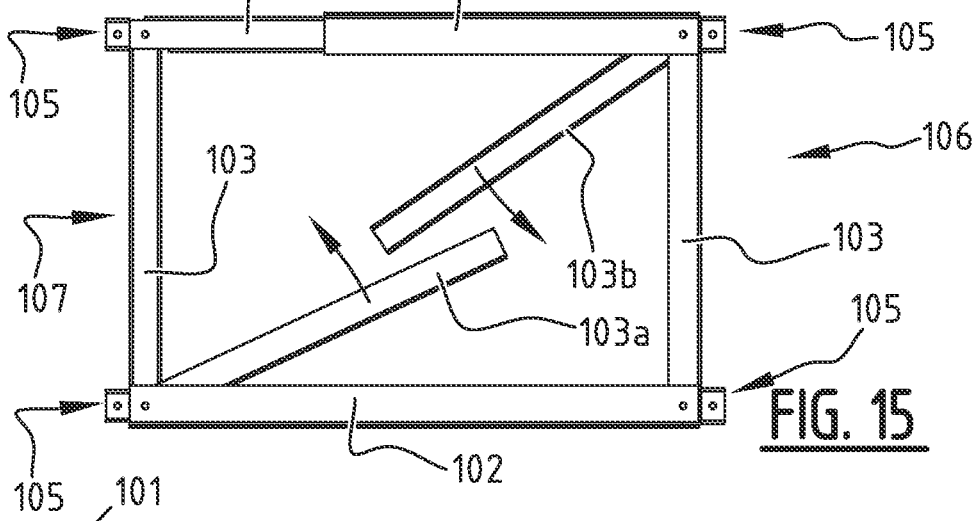
Figure 16:
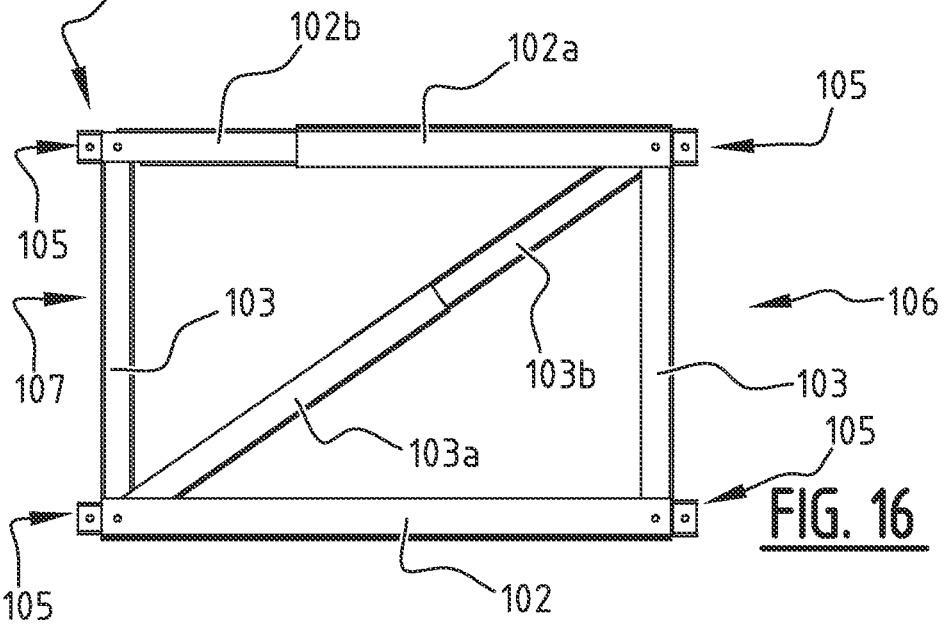
Figure 17:
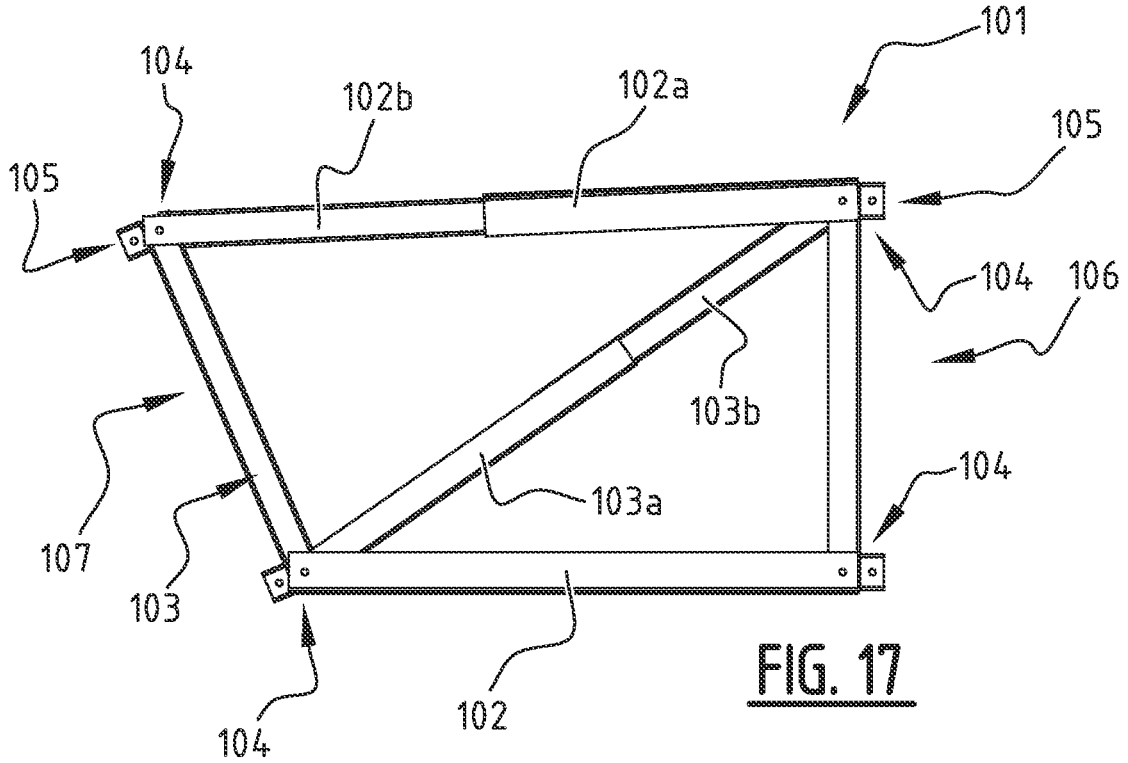
FIG. 17 shows a side view of the framework of FIG. 12 wherein a length adjustable connecting rib is shown in an extended state relative to FIG. 16.
Figure 18:
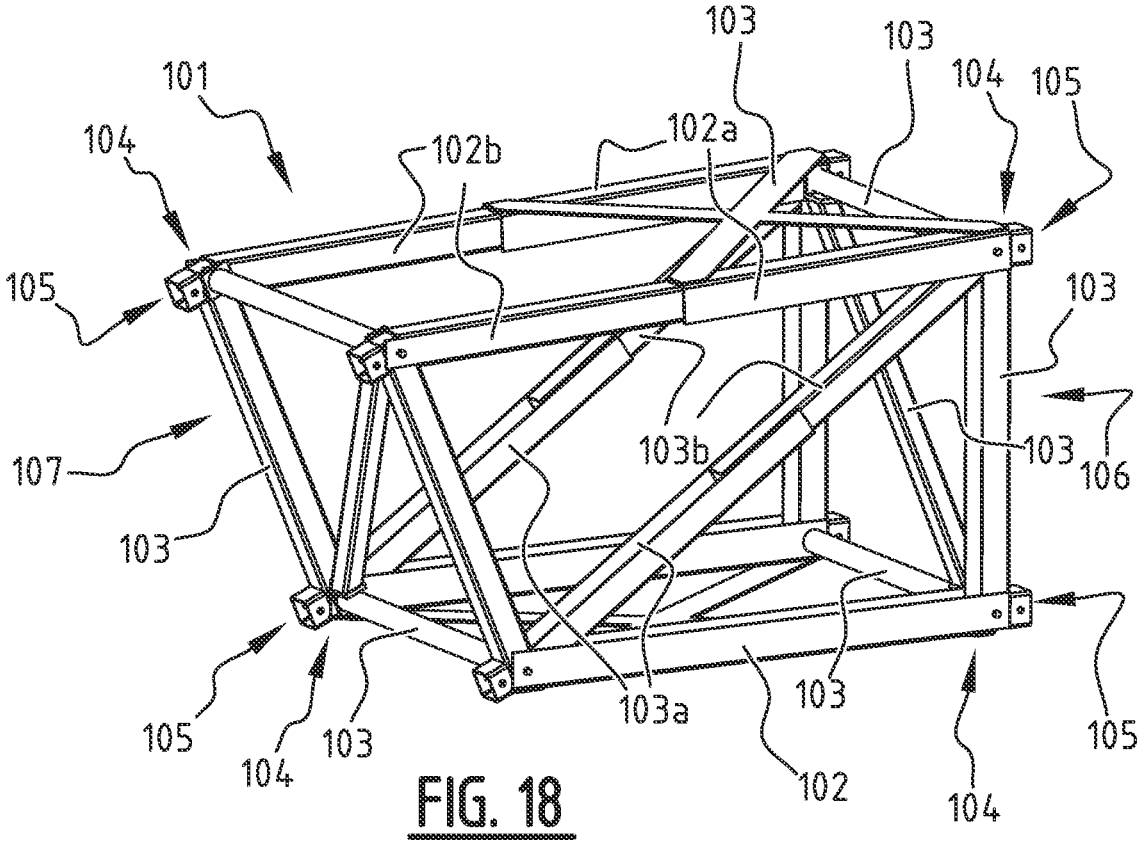
FIG. 18 is a perspective view of the framework of FIG. 17.
Figure 19:
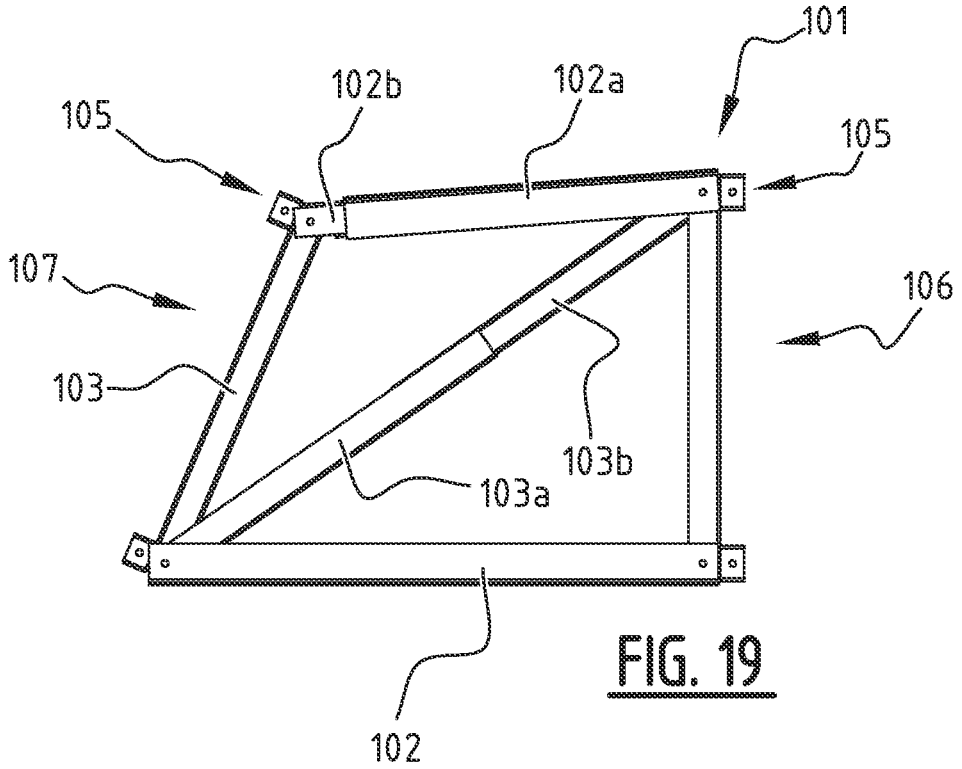
FIG. 19 shows a side view of the framework of FIG. 12 wherein a length adjustable connecting rib is shown in a contracted state relative to FIG. 16 and FIG. 17.
Figure 20:
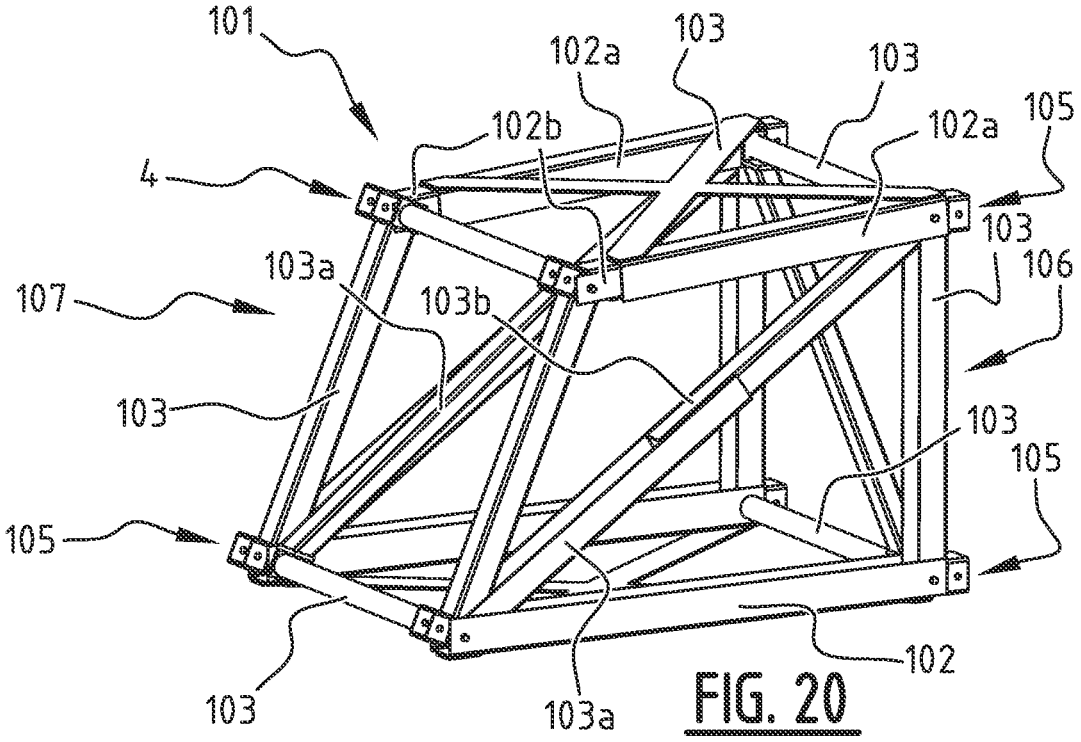
FIG. 20 is a perspective view of the framework of FIG. 19.

At least one connecting rib 103, which is preferably the connecting rib 103 that is length adjustable, comprises two parts 103*a*, 103*b* that are moveable relative to each other. In the shown embodiment, part 103*a* and part 103*b* are slideable relative to each other, and may also be engaged and disengaged (FIG. 15).

Just as for the triangular embodiment, some connecting ribs 103 only serve as reinforcement, and the number of such reinforcing connecting ribs 103 may be increased or decreased dependent on the required strength and rigidity. At both opposite ends 106, 107 of the framework 101, four connecting ribs 103 are arranged between four connectors 105 to form a rigid square, allowing multiple frameworks 101 to be easily connected to form a system 108 of interconnected frameworks 101 (FIG. 21).

Although not explicitly shown, also for the second embodiment, the opposite ends 106, 107 may be connected freely to one of the opposite ends 106, 107 of a further framework 101, thereby providing improved form freedom and design capabilities, similar to the first embodiment described above.

Furthermore, a rectangular framework 101 defining a square cross section, allows connecting frameworks to be arranged in four positions relative to each other, i.e. having a relative rotation of 90° along the longitudinal axes thereof, wherein the longitudinal axes extend parallel to the posts 102. Due to at least two posts 102 being length adjustable, each framework 101 may be given a desired shape (FIGS. 17-20). Consequently, a system 108 that is formed by an assembly of multiple frameworks 101 may define three-dimensional shapes.

The second embodiment has the advantage that, in a collapsed state of the framework 101, connectors 105 on opposite sides 106, 107 of the framework 101 are directed in opposite directions (FIG. 13). This allows a system 108 of multiple interconnected frameworks 101 to be collapsed as a whole (FIG. 22), i.e. without the need of disassembling the system 108 into separate frameworks 101.

A third embodiment, which is a further improvement of the first embodiment, is shown in FIGS. 23 and 24. In fact, the only distinguishing features between the first embodiment and the third embodiment is the absence of three connecting ribs 3, which can be best seen when comparing FIGS. 1 and 23.

Because of the close resemblance and in order to avoid unnecessary repetition in the description, common features are given the same references number plus 200, i.e. framework 201 relates to framework 1, post 202 relates to post 2, etc. Unless explicitly stated otherwise, the features work the same. Relative to the first embodiment, material and weight are saved while functionality is maintained.

Due to the absence of three connecting ribs 3, the frameworks 201 are easier to connect with an adjacent framework 201, because the positions of the connectors 205 are relatively free to move into an engaging position, also avoiding stresses in the framework 201 that may be caused if the framework 201 is over-defined in a mechanical sense.

According to the third embodiment, frameworks 201 are normally connected with an end 206 connected to an end 207 of an adjacent framework 201. However, it is still possible to connect an end 206 of a framework 201 to an end 206 of an adjacent framework 201 by using a (not shown) intermediate adapter or a long length adjustable member, such as a turnbuckle. The intermediate adapter may cause the connected frameworks 201 to resemble a framework 1 according to the first embodiment.

According to the third embodiment shown in FIG. 23, the length adjustable post 202 is connected to a triangle of connecting ribs 203 at its end 207, whereas the opposite end 206 of the length adjustable post 202 is dangling in the air. The length adjustable post 202 may swivel around hinge 204, which provides freedom of movement to the length adjustable post 202. The two connecting ribs 3 that are absent in the third embodiment relative to the first embodiment are redundant, because when the framework 201 is connected to an adjacent framework 201 in a system of interconnected frameworks 201 as shown in FIG. 24, rigidity is obtained. After all, the position of the end 207 of the length adjustable post 202 opposite the end 206 that is connected to the triangle of connecting ribs 203 will connect to a further framework 201 that has rigidity because of its respective triangle of connecting ribs 203.

Although many applications are possible, the framework 1, 101, 201, 301 is especially suitable to define at least a portion of a supporting structure for mounting at least one stage apparatus, such as a lamp and/or a speaker. The versatility offered by the framework 1, 101, 201, 301 offers many advantages for stage building, such as the freedom to design multiple shapes and easy storage and logistics during a (world) tour.

As mentioned before, a plurality of frameworks 1, 101, 201, 301 may be interconnected to define a system 8, 108, 208. In the first embodiment, at least one post 2 that is length adjustable comprises a drive 21 configured to adjust the length of said post 2. Although not explicitly shown, also the second embodiment may comprise a drive configured to adjust the length of said post 102. Alternatively, the second embodiment may comprise at least one connecting rib 103 that is length adjustable that comprises a (not shown) drive configured to adjust the length of said connecting rib 103. The system 8, 108, 208 may comprise a controller 22 that is configured to control the drive 21 of at least one framework 8 to thereby adjust the shape of said system 8, 108 via said framework 1, 101. Such a controller 22 is only shown for the first embodiment (FIG. 3), but may be used in combination with any of the four embodiments. The controller 22 may be configured to control the drive 21 of at least one post that is length adjustable, and/or may be configured to control a (not shown) drive of at least one connecting rib 103 that is length adjustable.

The fourth embodiment of FIG. 25 is an alternative to the third embodiment and functions in the same way. In order to avoid unnecessary repetition, for the functionality of the features reference is made to the description of the first and third embodiment.

The framework 301 according to the fourth embodiment may be slightly adapted to improve transportability thereof. According to a first improvement, the connecting ribs 303 that are shown in the lower plane of FIG. 25 may be detachable to allow multiple frameworks 301 to be stacked as upside-down V-shapes. According to a second improvement, the hinge 304 may be disconnectable to allow the upward directed sides of the triangular framework 301 shown in FIG. to be folded sideways to define a flat plane together with the lower plane of the framework 301 shown in FIG. 25.

Although they show preferred embodiments of the invention, the above described embodiments are intended only to illustrate the invention and not to limit in any way the scope of the invention. Accordingly, it should be understood that where features mentioned in the appended claims are followed by reference signs, such signs are included solely for the purpose of enhancing the intelligibility of the claims and are in no way limiting on the scope of the claims. Furthermore, it is particularly noted that the skilled person can combine technical measures of the different embodiments. The scope of the invention is therefore defined solely by the following claims.

The invention claimed is:

1. A framework defining a building block for defining, in assembly with at least one adjoining framework, a supporting structure, said framework comprising:

at least three posts; and at least three connecting ribs between the at least three posts;

wherein first ends of the posts define a first plane; and wherein second ends of the posts, that are opposite to the first ends thereof, define a second plane;

wherein at least one of the posts is length adjustable, wherein the at least one of the posts that is length adjustable defines, in combination with a further post of the at least three posts and two connecting ribs between the post that is length adjustable and the further post, an adjustable trapezium having a single length adjustable side defined by the post that is length adjustable; and wherein said adjustable trapezium is configured to set a relative orientation between the first plane and the second plane and to thereby set an orientation of the adjoining framework relative to the framework.

2. The framework of claim 1, further comprising at least one hinge between at least one connecting rib and at least one post; and wherein at least one post comprises two hinges, wherein each hinge is configured to connect said post to a respective connecting rib.

3. The framework of claim 1, wherein at least one connecting rib at least one of:

comprises two hinges, wherein each hinge is configured to connect said connecting rib to a respective post; and is length adjustable.

4. The framework of claim 1, comprising one or more than one connector that is configured to connect said framework to an adjoining framework; and wherein at least one of:

a plurality of connectors is arranged uniformly distributed on a circle; and the connector is arranged or arrangeable at or near an end of a post.

5. The framework of claim 1, wherein the at least one post that is length adjustable comprises a drive configured to adjust the length of said post.

6. The framework of claim 3, wherein the at least one connecting rib that is length adjustable comprises a drive configured to adjust the length of said connecting rib.

7. The framework of claim 1, wherein:

the framework is collapsible into a collapsed state; and at least one post comprises two parts that are engageable and disengageable.

8. The framework of claim 1, wherein at least one connecting rib comprises two rib parts that are at least one of:

moveable relative to each other; and engageable and disengageable.

9. The framework of claim 3, wherein the at least one connecting rib that is length adjustable comprises the two rib parts that are moveable relative to each other.

10. The framework of claim 1, wherein three posts define a triangular cross section.

11. The framework of claim 1, wherein:

at least one hinge between the post and the connecting rib defines an offset;

wherein at least one further hinge between the post and the connecting rib defines a further offset that is different from the offset defined by the at least one hinge; and wherein the hinge that defines the offset and the further hinge that defines the further offset are more preferably arranged at opposing ends of a post.

12. The framework of claim 11, wherein the at least three posts comprise at least four posts, and wherein at least two posts are length adjustable; and wherein the four posts define a rectangular cross section or a square cross section.

13. The framework of claim 10, further comprising at least one connector configured to connect said framework to an adjoining framework; and wherein at least one of:

a plurality of connectors is arranged uniformly distributed on a circle; and the connector is arranged or arrangeable at or near an end of a post;

wherein the framework is collapsible into a collapsed state;

wherein at least one post comprises two parts that are engageable and disengageable; and wherein, in a collapsed state of the framework, connectors on opposite sides of the framework are directed in opposite directions.

14. The framework of claim 1, wherein the framework defines at least a portion of a supporting structure for mounting at least one stage apparatus.

15. A system comprising a plurality of the frameworks of claim 1 interconnected;

the system further comprising a controller that is configured to control the drive of at least one framework to thereby adjust the shape of said system via said framework;

wherein the controller is configured to at least one of:

control the drive of at least one post that is length adjustable; and control the drive of at least one connecting rib that is length adjustable.

* * * * *